US007722139B1

(12) United States Patent
Chen et al.

(10) Patent No.: US 7,722,139 B1
(45) Date of Patent: May 25, 2010

(54) MECHANISM FOR QUICKLY ASSEMBLING OR DISASSEMBLING DRAWER SLIDE

(75) Inventors: Kung-Cheng Chen, Taichung (TW); Lung-Chuan Huang, Taichung (TW)

(73) Assignee: E-Make Co., Ltd., Taichung (TW)

( * ) Notice: Subject to any disclaimer, the term of this patent is extended or adjusted under 35 U.S.C. 154(b) by 0 days.

(21) Appl. No.: 12/424,555

(22) Filed: Apr. 16, 2009

(51) Int. Cl.
*A47B 88/04* (2006.01)

(52) U.S. Cl. ..... 312/334.7; 312/330.1

(58) Field of Classification Search ..... 312/330.1, 312/334.1, 334.7, 334.8, 333, 334.44, 350; 384/20, 21, 22
See application file for complete search history.

(56) References Cited

U.S. PATENT DOCUMENTS 2,686,704 A * 8/1954 Wolters ..... 312/257.1
2,815,649 A * 12/1957 Di Angelus et al. ..... 312/408
3,771,849 A * 11/1973 Barber ..... 312/350
4,440,461 A * 4/1984 Powell et al. ..... 312/334.8
4,469,384 A * 9/1984 Fler et al. ..... 312/333
5,632,542 A * 5/1997 Krivec ..... 312/334.7
5,681,102 A * 10/1997 Forsgren ..... 312/334.1
5,775,786 A * 7/1998 Liebertz ..... 312/334.8
5,785,401 A * 7/1998 Bowyer et al. ..... 312/350
5,927,838 A * 7/1999 Hellman, Jr. ..... 312/257.1
6,076,908 A * 6/2000 Maffeo ..... 312/334.7
6,948,967 B2 * 9/2005 Scherer et al. ..... 439/377

* cited by examiner

*Primary Examiner*—James O Hansen

(57) ABSTRACT

A slide assembly includes an outer slide member on either side of a cabinet; two inner slide members each adapted to move relative to the outer slide member and comprising front and rear tabs each having an adjacent opening; a front locking unit on either side of a drawer and comprising a first projection having a flat side surface, and a downward bent first snapping member disposed rearward of the first projection; and a rear locking unit formed on either side of the drawer and comprising a second projection having a flat side surface, and a downward bent first snapping member disposed forwardly of the second projection. The first snapping member can be locked between the front opening and the front tab and the second snapping member can be locked between the rear opening and the rear tab without using tools.

1 Claim, 7 Drawing Sheets

MECHANISM FOR QUICKLY ASSEMBLING OR DISASSEMBLING DRAWER SLIDE

BACKGROUND OF THE INVENTION

1. Field of Invention

The invention relates to drawer slides and more particularly to a mechanism for quickly assembling a slide on either side of a drawer and detaching the slide therefrom without using tools.

2. Description of Related Art

A conventional slide assembly mounted on either side 2 of a drawer 1 and a corresponding side of a cabinet (not shown) is shown in FIG. 1. Either side 2 of the drawer 1 is provided with a longitudinal inner slide member 3. Also, either side of an inner surface of the cabinet is provided with a longitudinal outer slide member 6. A plurality of screws 5 are driven through the inner slide member 3 into either side of the drawer 1 to secure the inner slide member 3 thereto. A slot 4 is formed on a position proximate a rear end of the inner slide member 3 for stopping the drawer 1 from pulling out of the cabinet when a latch (not shown) on the outer slide member 6 enters the slot 4.

However, an assembly of the conventional slide assembly on the drawer 1 and the cabinet is a complicated process due to threading. Further, a repair of any malfunctioned component is not an easy task. Furthermore, the slide assembly tends to malfunction or even damage if heavy objects are stored in the drawer 1 for a long period of time.

There is another type of conventional slide assembly commercially available. Either side of a drawer is provided with an inner slide member having front and rear slots. Either side of an inner surface of a cabinet is provided with an outer slide member. The outer slide member has front and rear latches each adapted to lockingly engage with the front or rear slot so as to allow the drawer to travel between a first position relative to the cabinet and a second position relative to the cabinet.

However, the locking components of the conventional slide assembly tend to deform after a short time of use. That is, it is not durable. Thus, continuing improvements in the exploitation of drawer slide are constantly being sought.

SUMMARY OF THE INVENTION

It is therefore one object of the invention to provide a mechanism for quickly assembling a slide on either side of a drawer and detaching the slide therefrom without using tools.

To achieve the above and other objects, the invention provides a telescoping slide assembly for supporting a movable drawer in a cabinet, the slide assembly comprising a stationary outer slide member on either side of the cabinet; two inner slide members each adapted to move relative to the outer slide member and comprising front and rear tabs of substantially curved cross-section, a front opening disposed laterally of the front tab, and a rear opening disposed laterally of the rear tab; a front locking unit formed on either side of the drawer and comprising a first projection having a flat side surface, and a downward bent first snapping member disposed rearward of the first projection; and a rear locking unit formed on either side of the drawer and comprising a second projection having a flat side surface, and a downward bent first snapping member disposed forwardly of the second projection, wherein the first snapping member is adapted to lockingly dispose between the front opening and the front tab, and the second snapping member is adapted to lockingly dispose between the rear opening and the rear tab.

By utilizing the invention, the following advantages can be obtained. Assembly and disassembly of the drawer slide are easy and can be done without using tools. The structural strength of the drawer is even increased. The retracting or extending operation of the drawer is facilitated.

The above and other objects, features and advantages of the invention will become apparent from the following detailed description taken with the accompanying drawings.

DETAILED DESCRIPTION OF THE INVENTION

Figure 1:
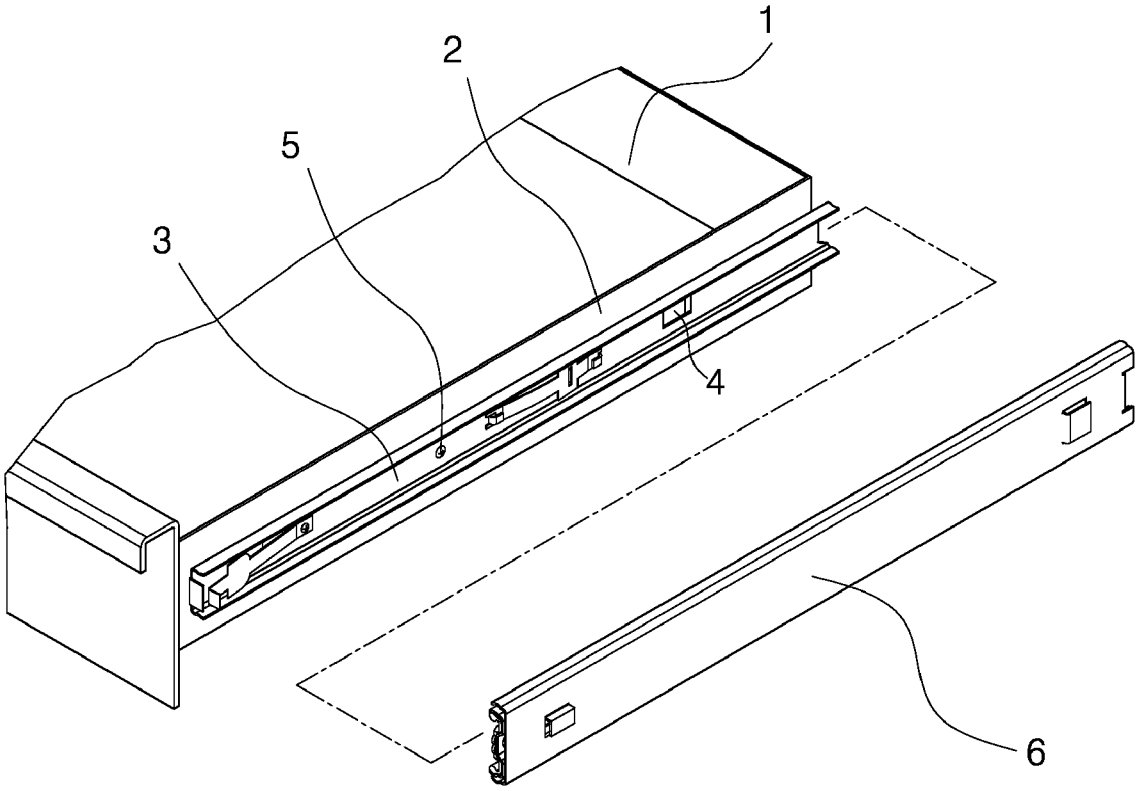
Fig.1 (PRIOR ART)
FIG. 1 is an exploded perspective view of one side of a drawer mounted with a conventional slide assembly.
Figure 2:
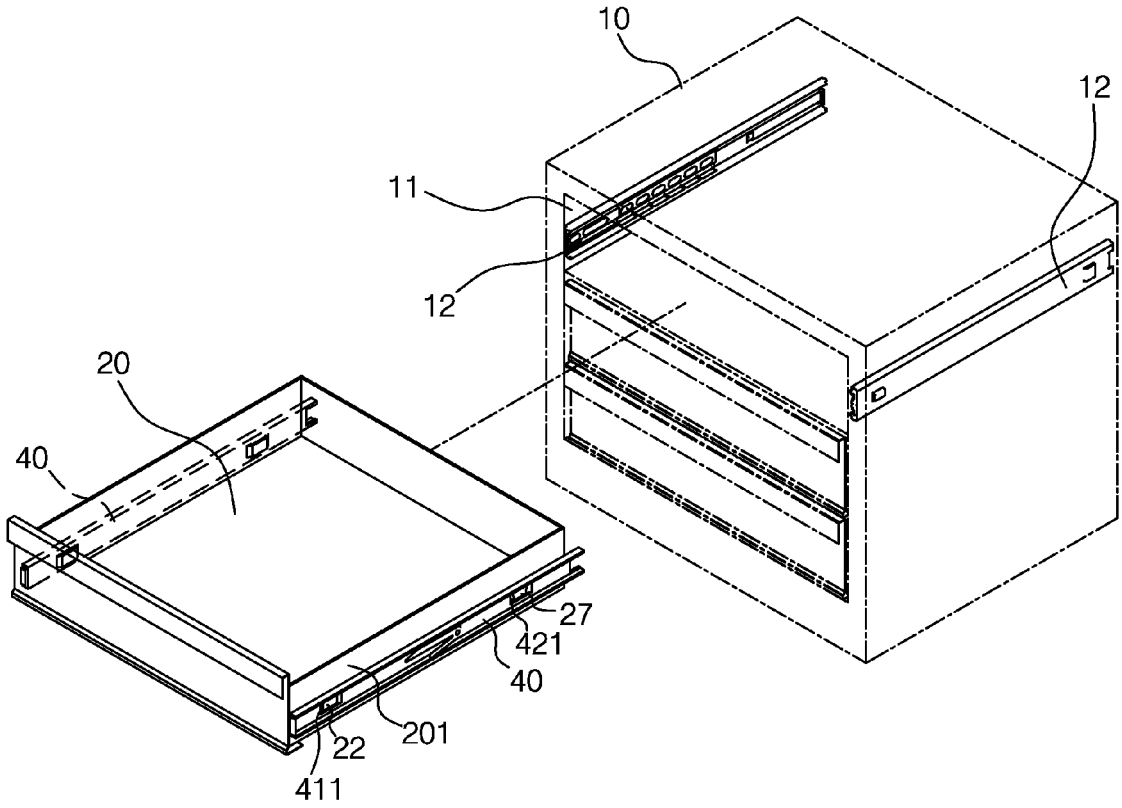
FIG. 2 is a perspective view of a drawer incorporating a portion of a preferred embodiment of slide assembly according to the invention to be assembled with the remaining portion thereon mounted on a cabinet shown in phantom.
Figure 3:
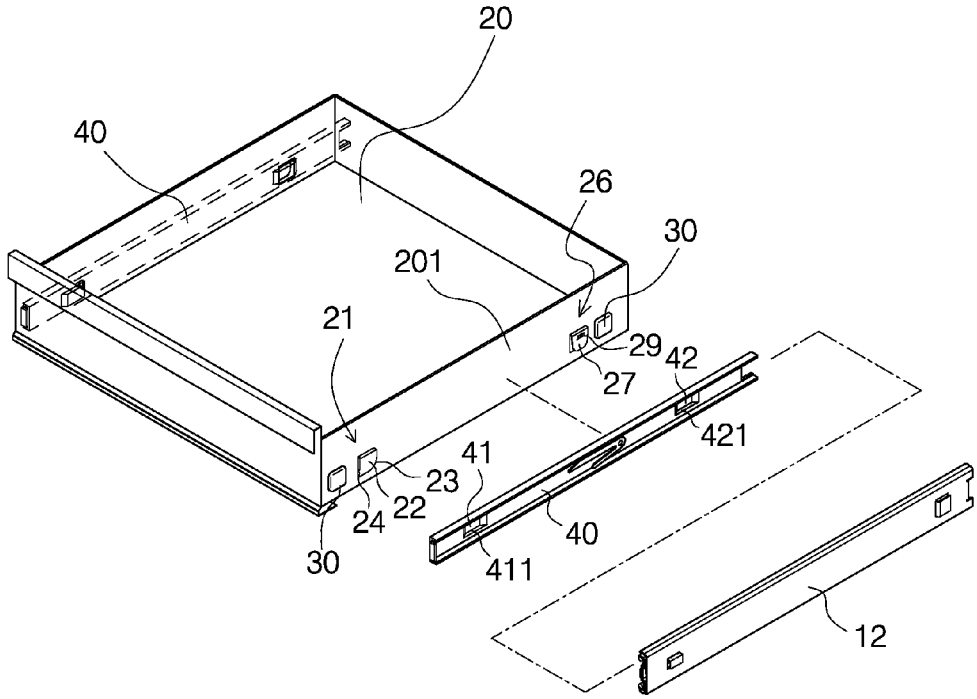
FIG. 3 is an exploded view of the portion of slide assembly on the drawer of FIG. 2.

Referring to FIGS. 2 to 11, a mechanism for quickly assembling a slide on either side of a drawer and detaching the slide therefrom without using tools in accordance with a preferred embodiment of the invention is shown.

A cabinet 10 has a sufficient space to accommodate a plurality of (three as shown) drawers 20 to slidably dispose therein. Either side of one of three levels of the cabinet 10 is provided with an outer slide member 12 which is well known in the art.

Either side 201 of the drawer 20 is provided with the mechanism of the invention. The mechanism comprises the following components as discussed in detail below.

An inner slide member 40 is provided on either side 201 of the drawer 20. The inner slide members 40 are adapted to move relative to the outer slide members 12 in order to retract the drawer 20 into the cabinet 10 or extend therefrom in a manner well known in the art.

Figure 4:
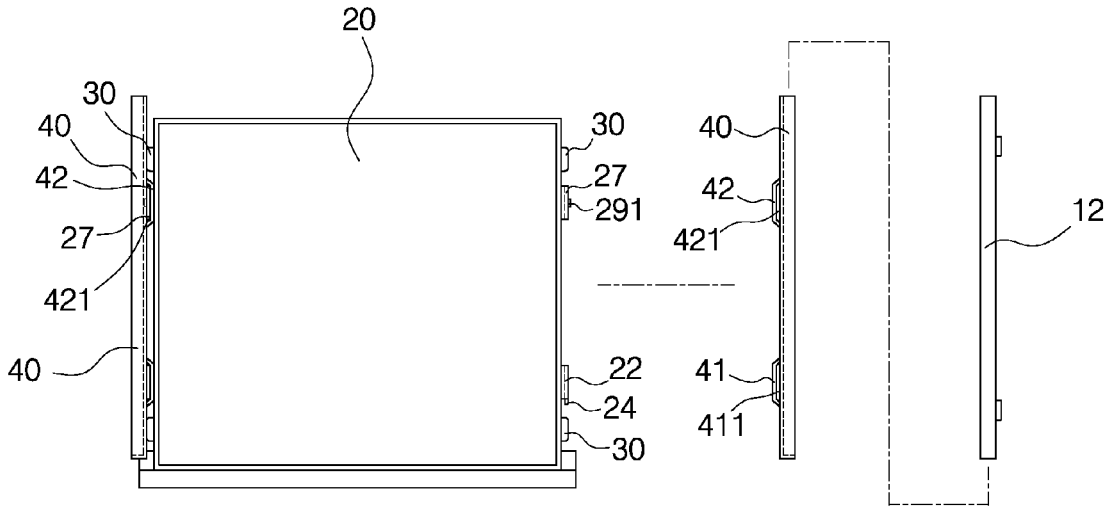
FIG. 4 is a top plan view of FIG. 3.
Figure 5:
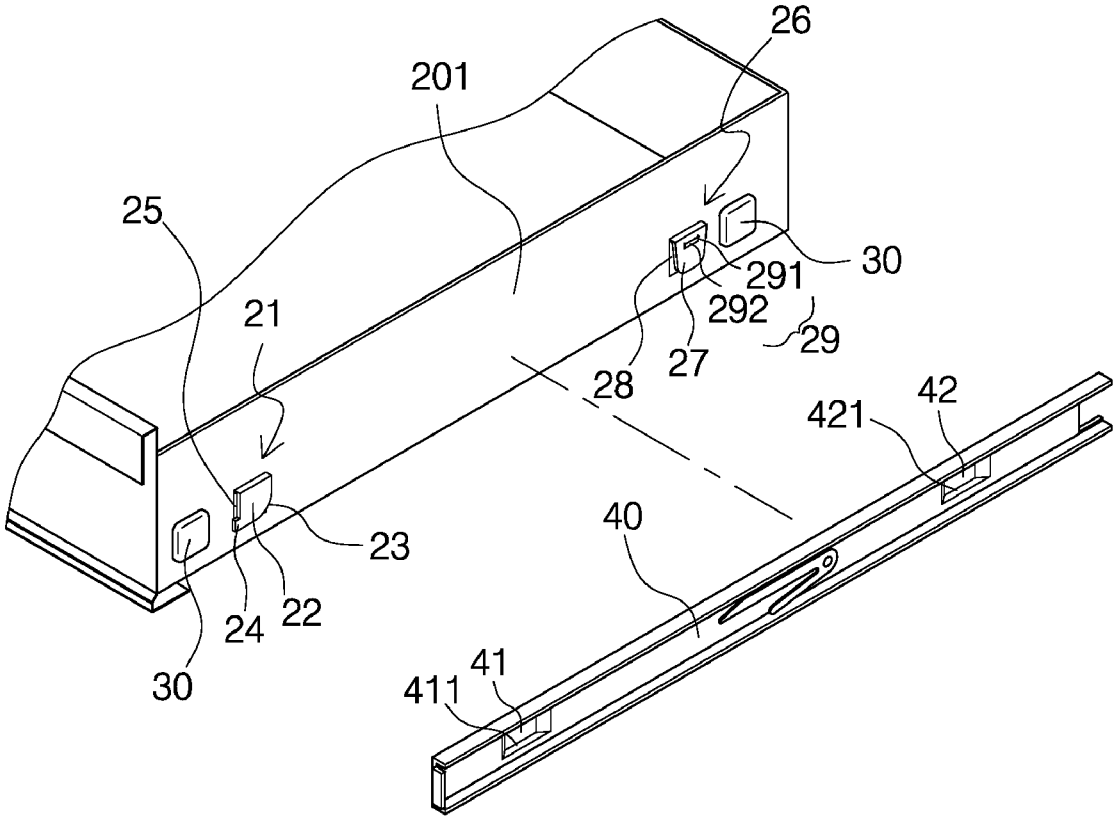
FIG. 5 is an enlarged view of a portion of FIG. 3 including one side of the drawer and the inner slide member.

Front and rear fastening units 21, 26 are provided on either side 201 of the drawer 20. A projection 30 with a flat side surface is provided forwardly of the front fastening unit 21 and a projection 30 with a flat side surface is provided rearward of the rear fastening unit 26 respectively. The projection 30 is about flush with either one of the fastening units 21, 26 as best shown in FIG. 4. Front and rear tabs 41, 42 of substantially curved cross-section are provided on the inner slide member 40. A front opening 411 is provided in the same place of the front tab 41 and a rear opening 421 is provided in the same place of the rear tab 42 respectively. The front fastening unit 21 comprises a downward bent first snapping member 22 and the rear fastening unit 26 comprises a downward bent second snapping member 27 respectively. A first gap 25 is formed between the first snapping member 22 and either side of the drawer 20 and a second gap 28 is formed between the second snapping member 27 and either side of the drawer 20 respectively.

Figure 6:
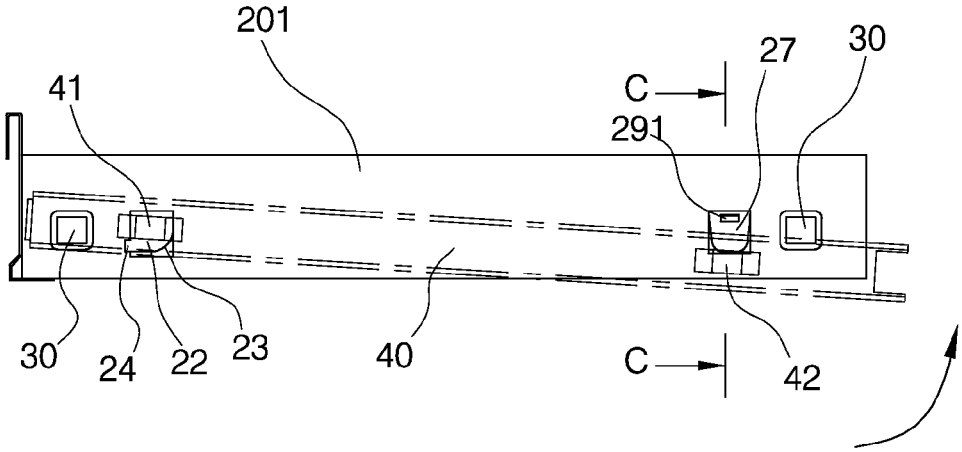
FIG. 6 is a side elevation of FIG. 5 showing the inner slide member being mounted on one side of the drawer.

As shown in FIG. 6, a bottom of the first snapping member 22 is formed with a forward projecting tongue 24. A curved corner 23 is formed on a rear bottom of the first snapping member 22.

Figure 7:
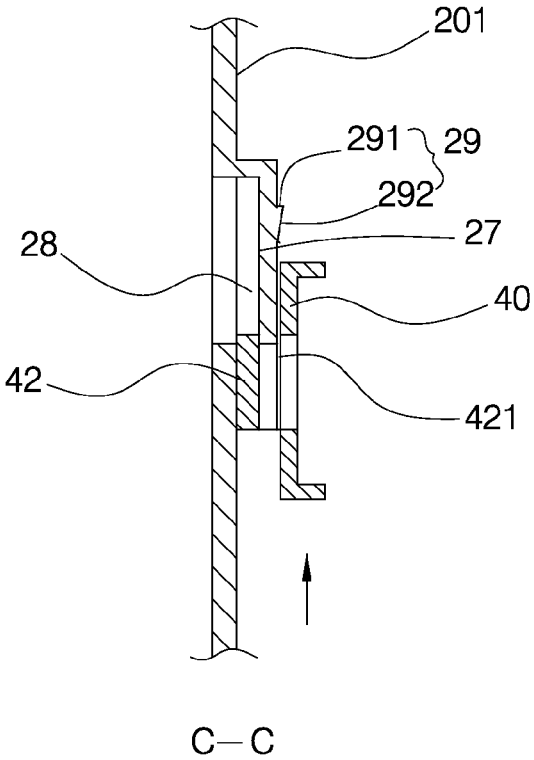
FIG. 7 is a sectional view taken along line C-C of FIG. 6.
Figure 8:
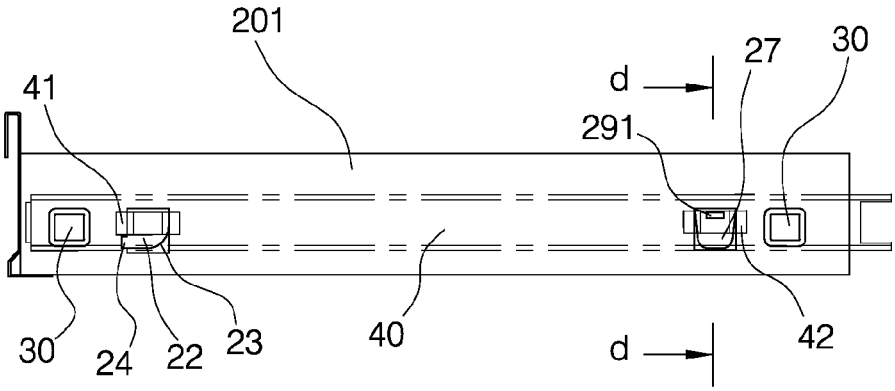
FIG. 8 is a view similar to FIG. 6 showing the inner slide member having been mounted on one side of the drawer.
Figure 9:
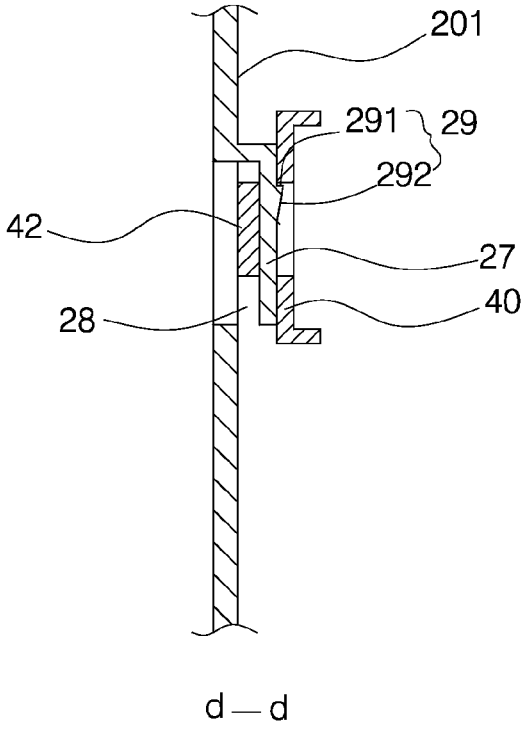
FIG. 9 is a sectional view taken along line D-D of FIG. 8.

As shown in FIG. 7, a latch 29 is formed on an outer surface of the second snapping member 27. The latch 29 comprises an upward inclined surface 292 and a shoulder 291 extending laterally from a top end of the inclined surface 292.

As shown in FIGS. 6 to 9, in assembly a person may first dispose the inner slide member 40 in a position that the rear tab 42 is below and about vertically aligned with the second snapping member 27 and the front tab 41 is above and about vertically aligned with the first snapping member 22 respectively. That is, the inner slide member 40 is inclined relative to one side 201 of the drawer 20 (see FIG. 6). Next, the person may press the first snapping member 22 downward by sliding the curved corner 23 into the front opening 411 until the tongue 24 is positioned below the front tab 41.

Next, the person may press the second snapping member 27 and then counterclockwise pivot the rear end of the inner slide member 40 as indicated by arrow in FIG. 6. Hence, the rear tab 42 slides along an inner surface of the inclined surface 292 to cause the shoulder 291 to enter the rear opening 421 via the second gap 28 (see FIGS. 6 to 9). As a result, the inner slide member 40 is mounted on one side 201 of the drawer 20.

Figure 10:
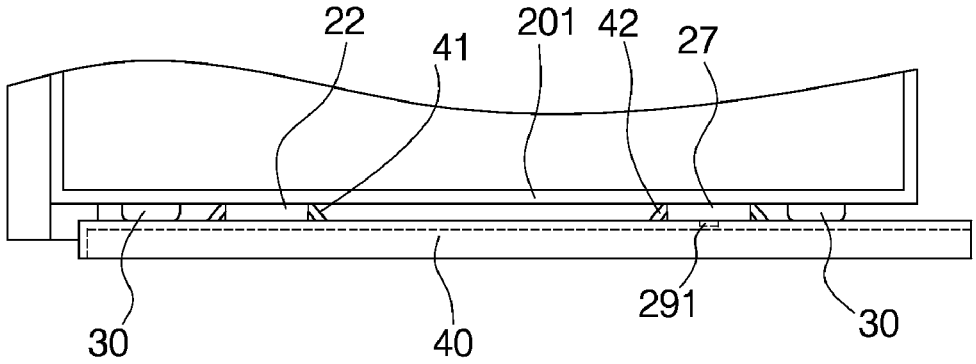
FIG. 10 is an enlarged view of the top of the right side portion of FIG. 2 showing the projections being urged against with the inner slide member.
Figure 11:
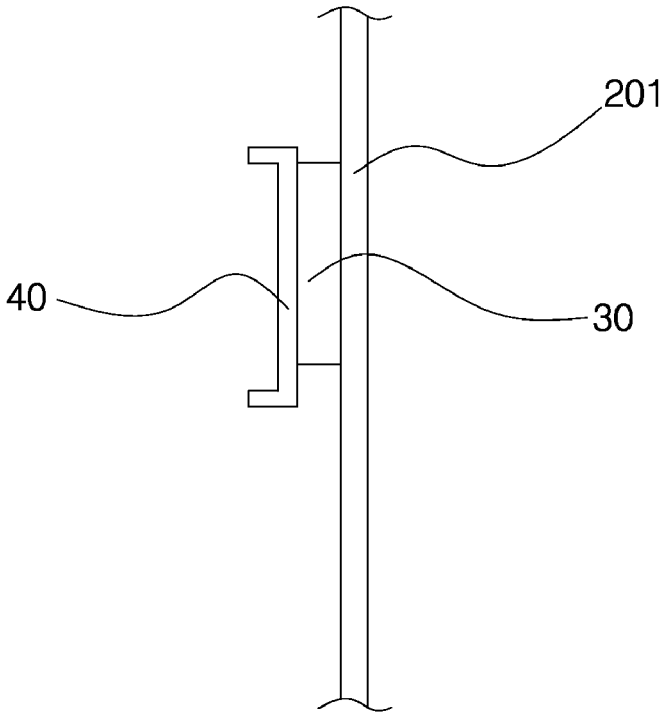
FIG. 11 is a rear view of a portion of FIG. 10 further showing the projection being urged against with the inner slide member.

As shown in FIGS. 10 and 11, at this assembled state the projections 30 are urged against with the inner slide member 40. Hence, the provision of the projections 30 can increase contact between the inner slide member 40 and the drawer 20 and increase operating stability when retracting or extending the drawer 20.

The invention has the following advantages. Its assembly and disassembly are easy and can be done without using tools. The structural strength of the drawer is even increased. The retracting or extending operation of the drawer is facilitated.

While the invention herein disclosed has been described by means of specific embodiments, numerous modifications and variations could be made thereto by those skilled in the art without departing from the scope and spirit of the invention set forth in the claims.

What is claimed is:

1. A telescoping slide assembly for supporting a movable drawer in a cabinet, the slide assembly comprising:

a stationary outer slide member on either side of the cabinet;

two inner slide members each adapted to move relative to the outer slide member and comprising front and rear tabs of substantially curved cross-section, a front opening disposed laterally of the front tab, and a rear opening disposed laterally of the rear tab;

a front locking unit formed on either side of the drawer and comprising a first projection having a flat side surface, and a downward bent first snapping member disposed rearward of the first projection with a first gap defined between the first snapping member and either side of the drawer;

a rear locking unit formed on either side of the drawer and comprising a second projection having a flat side surface, and a downward bent second snapping member disposed forwardly of the second projection with a second gap defined between the second snapping member and either side of the drawer;

a latch formed on an outer surface of the second snapping member, the latch comprising an upward inclined surface and a shoulder extending laterally from a top end of the inclined surface;

a forward tongue formed on a bottom of the first snapping member; and a curved corner formed rearward of the tongue on the bottom of the first snapping member, wherein the first snapping member is adapted to lockingly dispose between the front opening and the front tab, and the second snapping member is adapted to lockingly dispose between the rear opening and the rear tab; and wherein the first projection is about flush with the first snapping member and the second projection is about flush with the second snapping member.

* * * * *